US010648479B2

(12) United States Patent
Amadon et al.

(10) Patent No.: US 10,648,479 B2
(45) Date of Patent: May 12, 2020

(54) STATOR SEGMENT CIRCUMFERENTIAL GAP SEAL

(71) Applicant: United Technologies Corporation, Farmington, CT (US)

(72) Inventors: Colin G. Amadon, Kennebunk, ME (US); Anthony R. Bifulco, Ellington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 38 days.

(21) Appl. No.: 15/797,577

(22) Filed: Oct. 30, 2017

(65) Prior Publication Data

US 2019/0128274 A1 May 2, 2019

(51) Int. Cl.

| | |
|---|---|
| ***F04D 29/08*** | (2006.01) |
| ***F01D 9/04*** | (2006.01) |
| ***F01D 11/00*** | (2006.01) |
| ***F04D 29/54*** | (2006.01) |

(52) U.S. Cl.

CPC ..... *F04D 29/083* (2013.01); *F01D 9/041* (2013.01); *F01D 11/005* (2013.01); *F04D 29/542* (2013.01); *F05D 2240/11* (2013.01)

(58) Field of Classification Search

CPC ..... F01D 9/02; F01D 11/001; F01D 11/22; F01D 25/04; F05D 220/32; F05D 2240/12; F05D 2240/55; F05D 2240/80; F05D 2220/32; F05D 2240/11; F04D 29/083; F04D 29/542; F04D 29/08; F16J 15/02

See application file for complete search history.

(56) References Cited

U.S. PATENT DOCUMENTS

| | | | | |
|---|---|---|---|---|
| 3,728,041 | A | 4/1973 | Bertelson | |
| 5,975,844 | A | 11/1999 | Milazar et al. | |
| 9,534,500 | B2 | 1/2017 | Bouchard et al. | |
| 2016/0003079 | A1 | 1/2016 | Boeke et al. | |
| 2016/0138412 | A1* | 5/2016 | Rioux | F01D 11/005 415/1 |

FOREIGN PATENT DOCUMENTS

| | | | |
|---|---|---|---|
| GB | 2401658 | A | 11/2004 |

OTHER PUBLICATIONS

European Search Report Issued in European Application No. 18203529.5, dated Mar. 6, 2019, 6 Pages.

* cited by examiner

*Primary Examiner* — Richard A Edgar
*Assistant Examiner* — Maxime M Adjagbe
(74) *Attorney, Agent, or Firm* — Cantor Colburn LLP

(57) ABSTRACT

A vane assembly for a gas turbine includes a first shroud segment, a second shroud segment, a first inner air seal, and a seal assembly. The first shroud segment has a first end face. The second shroud segment is disposed adjacent to the first shroud segment and has a second end face that faces towards and is spaced apart from the first end face by a gap. The first inner air seal extends into the first shroud segment and defines a first trench. The seal assembly at least partially received within the first trench.

9 Claims, 5 Drawing Sheets

STATOR SEGMENT CIRCUMFERENTIAL GAP SEAL

BACKGROUND

Exemplary embodiments pertain to the art of gas turbine engines and more particularly to sealing arrangements.

A gas turbine engine includes segmented components having inter-segment gaps. Airflow may leak through the inter-segment gaps, thus reducing the overall efficiency of the gas turbine engine. Common approaches include using a thin sealing strip into machine grooves that are defined in end surfaces that may define the inter-segment gaps. Substantial redesign or rework may occur to incorporate such sealing strips. Accordingly it is desirable to provide a seal for sealing the inter-segment gaps that may be placed into existing parts with minimal impact to cost and weight.

BRIEF DESCRIPTION

Disclosed is a vane assembly for a gas turbine that includes a first shroud segment, a second shroud segment, a first inner air seal, and a seal assembly. The first shroud segment has a first end face. The second shroud segment is disposed adjacent to the first shroud segment and has a second end face that faces towards and is spaced apart from the first end face by a gap. The first inner air seal extends into the first shroud segment and defines a first trench. The seal assembly at least partially received within the first trench.

In addition to one or more of the features described herein, a second inner air seal engages the second shroud segment that is disposed adjacent to the second inner air seal.

In addition to one or more of the features described herein, the seal assembly is at least partially received between the second inner air seal and the second shroud segment.

In addition to one or more of the features described herein, the seal assembly engages an inner surface of the first shroud segment and an inner surface of the first inner air seal.

In addition to one or more of the features described herein, the seal assembly engages an inner surface of the second inner air seal.

In addition to one or more of the features described herein, the seal assembly includes a hollow member made of a first material.

In addition to one or more of the features described herein, a fill disposed within the hollow member that is made of a second material.

Also disclosed is a vane assembly for a gas turbine engine. The vane assembly includes a first shroud segment, a first inner air seal, and a seal assembly. The first shroud segment has a first platform, a first leg extending from the first platform, and a second leg spaced extending from the first platform and spaced apart from the first leg. The first inner air seal at least partially extends into the first shroud segment. The first inner air seal has a first face and a second face that is spaced apart from the first face and defines a first trench therebetween. The seal assembly is received within the first trench.

In addition to one or more of the features described herein, the seal assembly includes a hollow member that is spaced apart from the first platform, the first leg, and the second leg.

In addition to one or more of the features described herein, the first inner air seal includes a first surface that engages the first leg, a second surface that engages the second leg, a third surface disposed parallel to the first surface and the second surface and spaced apart from the first platform, a fourth surface extending between the first surface and the third surface, and a fifth surface extending between the second surface and the third surface.

In addition to one or more of the features described herein, the seal assembly includes a pedestal that is operatively connected to the hollow member.

In addition to one or more of the features described herein, the pedestal engages the second face and engages at least one of the first surface, the second surface, the third surface, the fourth surface, and the fifth surface.

In addition to one or more of the features described herein, the pedestal engages the first leg, the second leg, and the first platform.

Further disclosed is a gas turbine engine. The gas turbine engine includes a vane assembly provided with at least one of a fan section and a compressor section. The vane assembly includes a first shroud segment, a first inner air seal, and a seal assembly. The first shroud segment is disposed adjacent to and is spaced apart from a second shroud segment. The first shroud segment has a first leg and a second leg each extending from a first platform. The first inner air seal is disposed adjacent to and is spaced apart from a second inner air seal. The first inner air seal extends into the first shroud segment and defines a first trench. The seal assembly is at least partially disposed within the first trench.

In addition to one or more of the features described herein, the first trench is defined between a first face and a second face of the first inner air seal.

In addition to one or more of the features described herein, the seal assembly includes a hollow member extending between a first end that engages a first surface of the first inner air seal that extends between the first face and the second face and a second end that engages a second surface of the first inner air seal that is spaced apart from the first surface and extends between the first face and the second face.

In addition to one or more of the features described herein, the hollow member has a first portion extending from the first end and engages the first leg, a second portion extending from the second end and engages the second leg, and a third portion extending between the first portion and the second portion and engages the first platform.

In addition to one or more of the features described herein, the hollow member has a first portion extending from the first end and is spaced apart from the first leg, a second portion extending from the second end and is spaced apart from the second leg, and a third portion extending between the first portion and the second portion and is spaced apart from the first platform.

In addition to one or more of the features described herein, the seal assembly includes a pedestal that is operatively connected to the hollow member and engages the second face.

In addition to one or more of the features described herein, a fill is disposed within the hollow member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
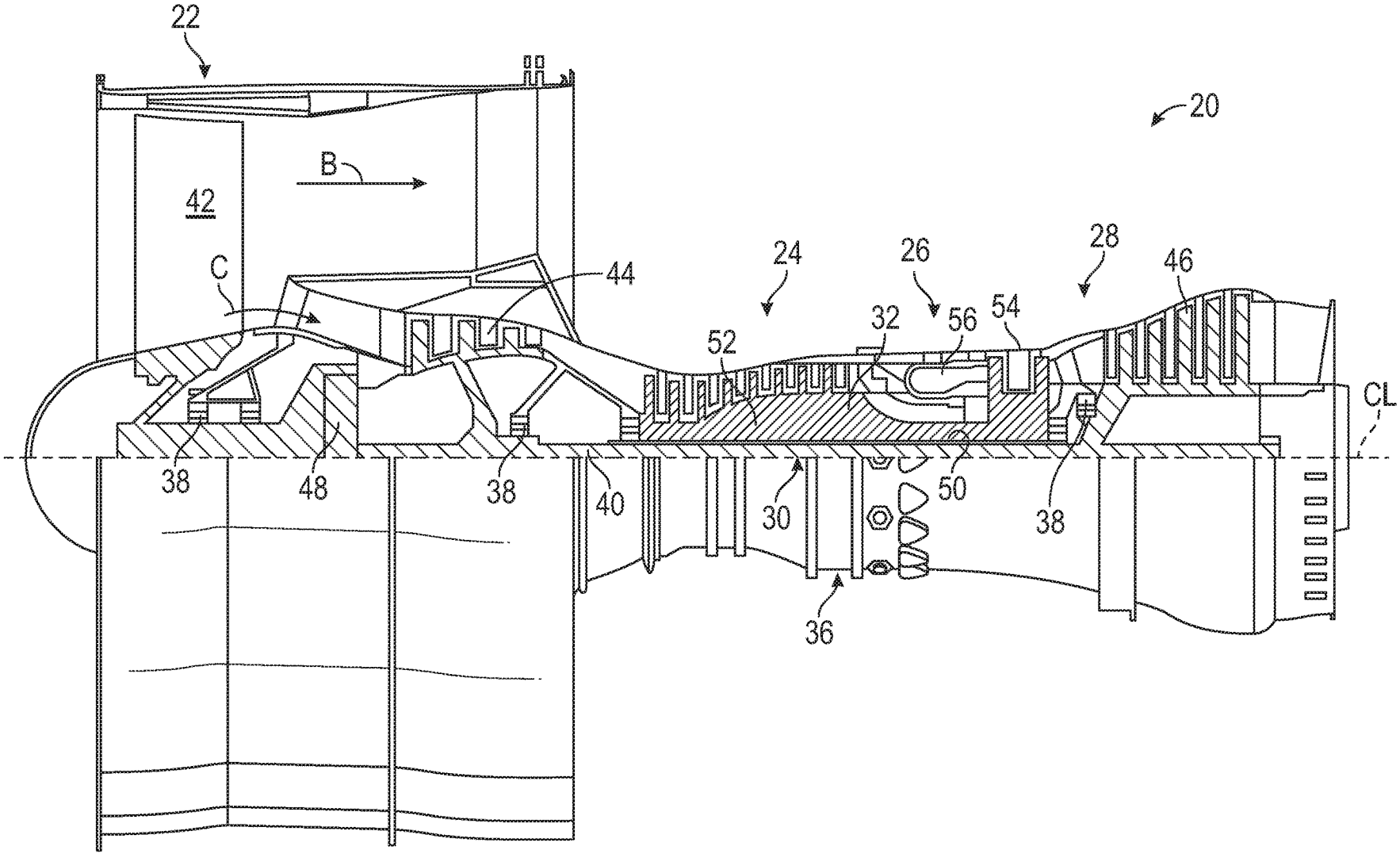
FIG. 1 is schematic illustration of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis, CL relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54.

A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis, CL which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
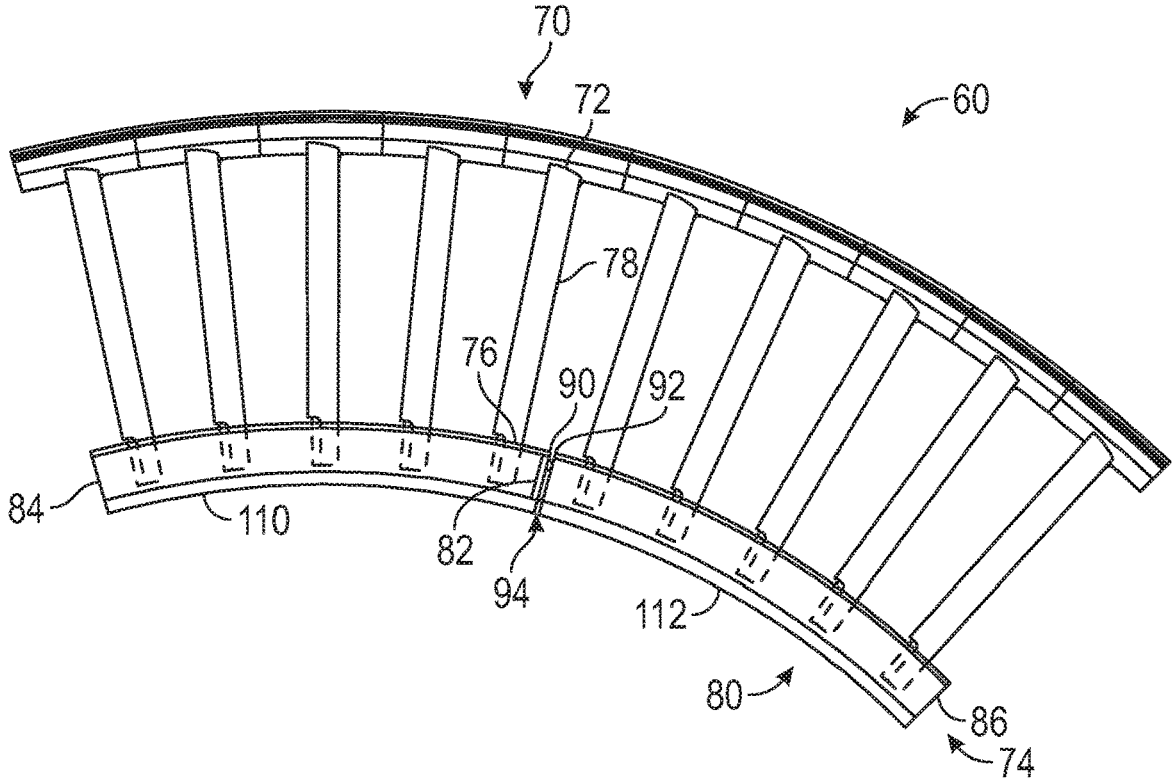
FIG. 2 is a partial view of a vane assembly having a seal assembly disposed between segments.

FIG. 2 is a schematic view of a portion of a segment of a vane assembly 60 that may be provided with at least one of the fan section 22 or the compressor section 24, e.g. the low pressure compressor 42 and/or the high pressure compressor 52. The vane assembly 60 includes a plurality of vane segments that are disposed adjacent to and are axially and circumferentially spaced apart from each other. As used herein, the term "axial" refers to axial with respect to the engine central longitudinal axis, CL. As used herein, the term "circumferential" refers to circumferential with respect to the engine central longitudinal axis, CL. As used herein, the term "radial" refers to radial with respect to the engine central longitudinal axis, CL.

Each vane segment includes a vane platform 70, a shroud 74, and an airfoil or a vane 78, an inner air seal 80, and a seal assembly 82. The vane platform 70 is disposed at a first radial boundary end 72 of the vane assembly 60. Each vane platform 70 of the plurality of vane segments generally abut each other.

The shroud 74 is disposed at a second radial boundary end 76 and the inner air seal 80 engages or abuts the shroud 74 at the second radial boundary end 76. The vane 78 radially extends between the first radial boundary end 72 and the second radial boundary end 76. The vane 78 at least partially extends into the shroud 74. The first radial boundary end 72 may be an outer radial end and the second radial boundary end 76 may be an inner radial end that is disposed closer to the engine central longitudinal axis, CL, then the outer radial end.

The shroud 74 includes a first shroud segment 84 and a second shroud segment 86 that is disposed adjacent to while being axially and circumferentially spaced apart from the first shroud segment 84. The first shroud segment 84 is arranged to receive ends of a portion of the plurality of vanes and the second shroud segment 86 is arranged to receive ends of another portion of the plurality of vanes.

Figure 3:
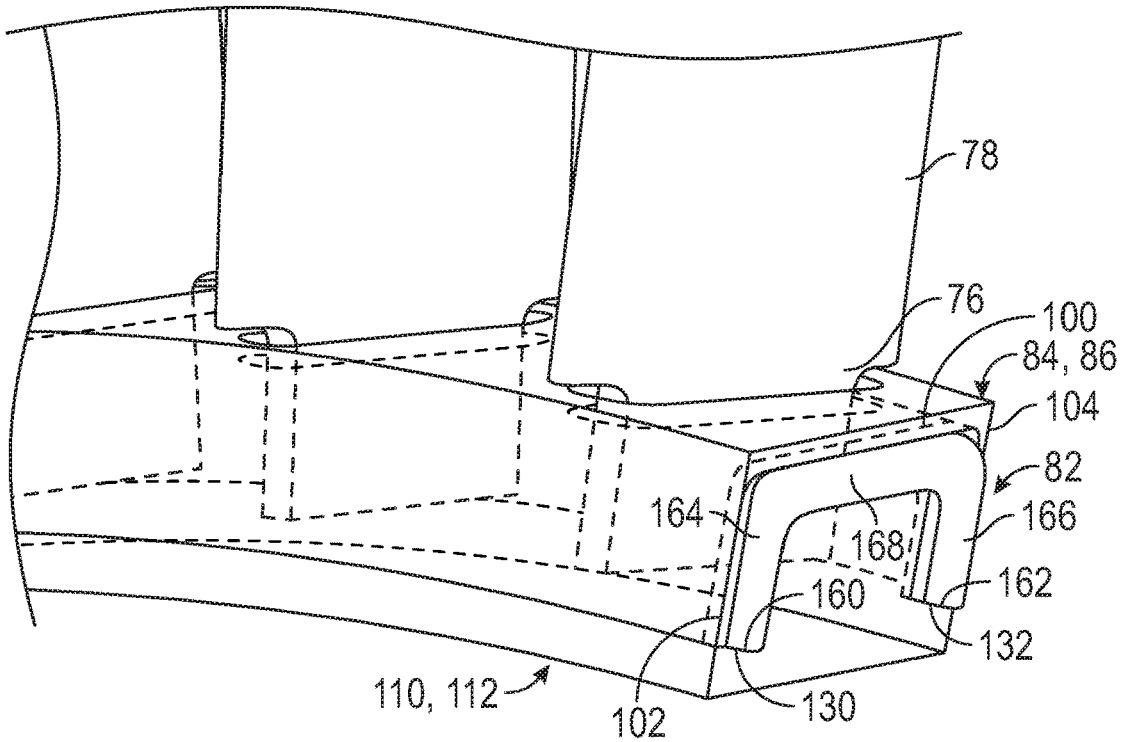
FIG. 3 is a partial view of a radial end of the vane assembly.
Figure 4:
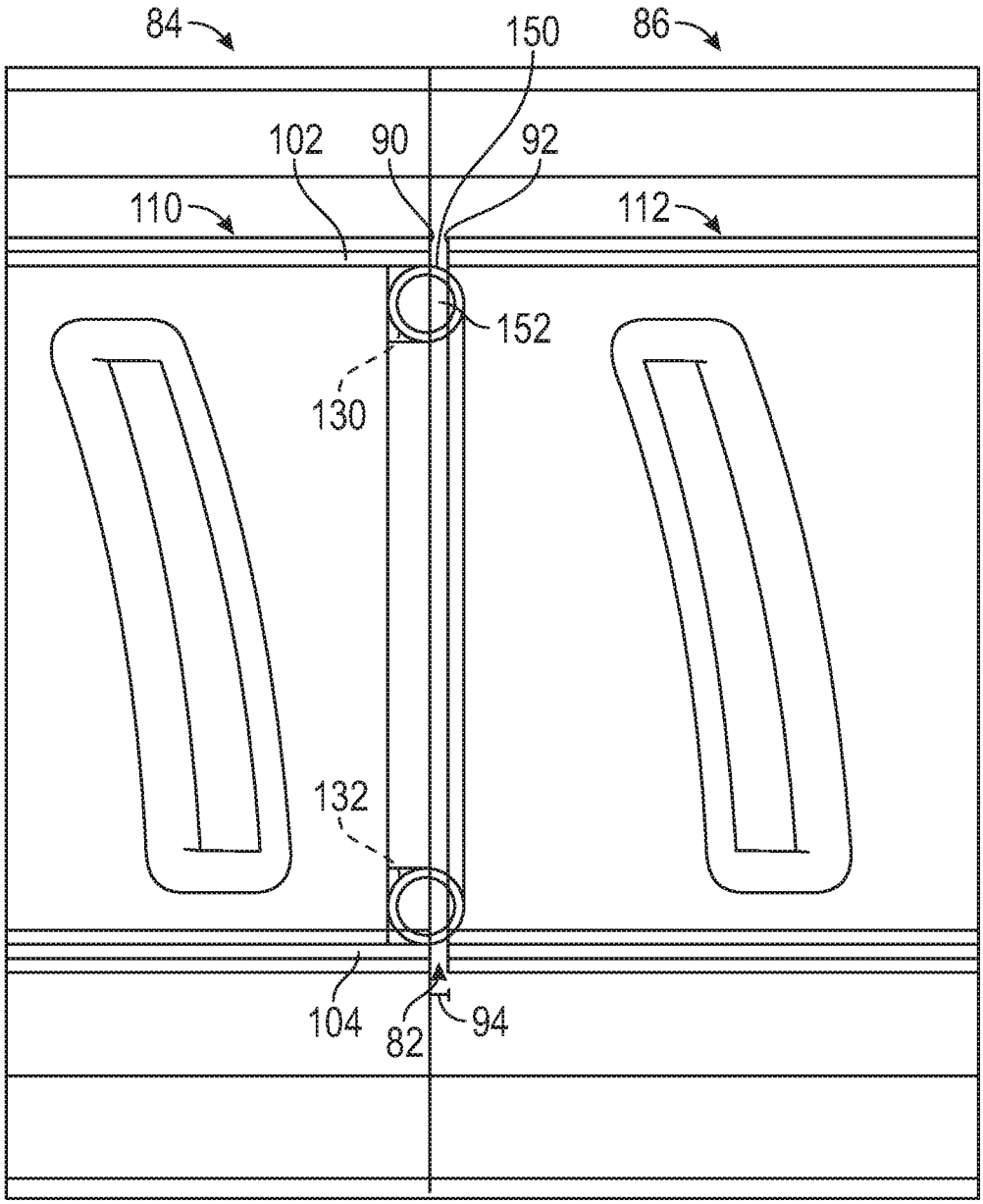
FIG. 4 is a bottom view of the vane assembly.

Referring to FIGS. 2-4, each of the first shroud segment 84 has a first end face 90 that faces towards and is spaced apart from a second end face 92 of the second shroud segment 86. A gap 94 is defined between the first end face 90 and the second end face 92, as shown in FIG. 4. The gap 94 between the first shroud segment 84 and the second shroud segment 86 and/or the gaps between adjacent vane platforms may provide a leakage path for an airflow that flows through the vane assembly 60.

Figure 5:
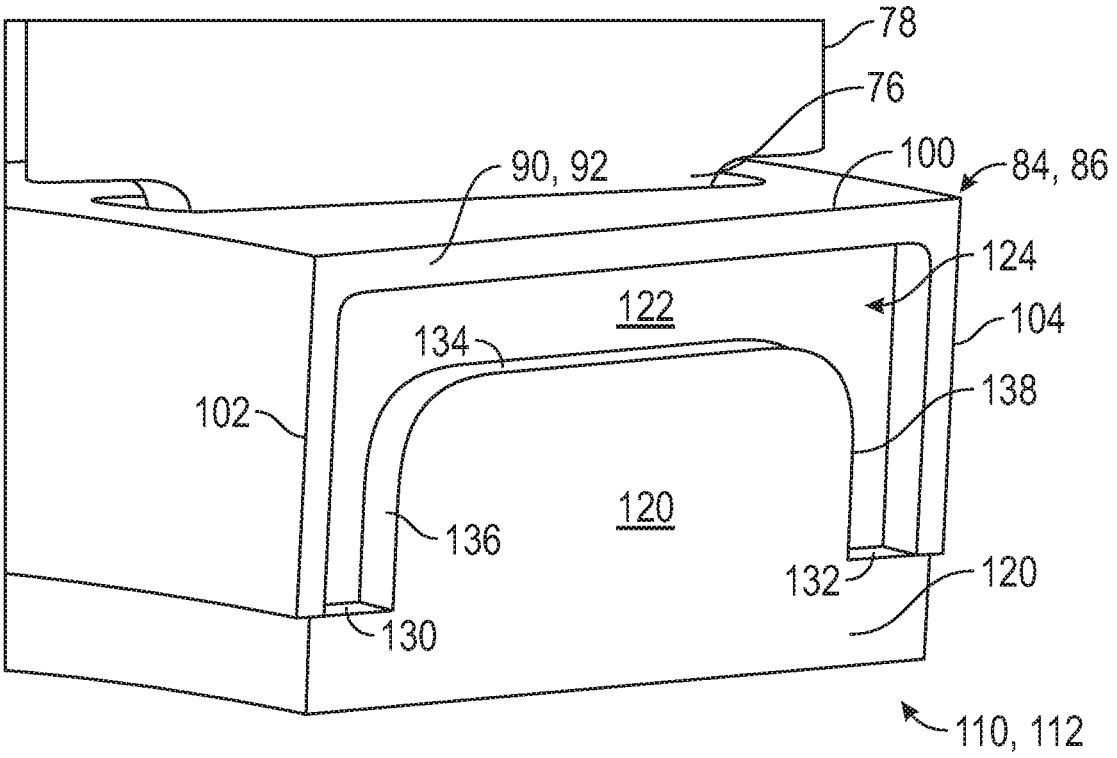
FIG. 5 is a partial view of a radial end of a shroud and an inner air seal of the vane assembly.

Referring to FIGS. 3 and 5, each of the first shroud segment 84 and the second shroud segment 86 includes a first platform 100, a first leg 102, and a second leg 104 that is spaced apart from the first leg 102. The first leg 102 and the second leg 104 each extend from the first platform 100 and extend towards the engine central line axis, CL. The first end face 90 extends between or may be defined by the first platform 100, the first leg 102, and the second leg 104.

The inner air seal 80 includes a first inner air seal 110 and a second inner air seal 112 that is disposed adjacent to while being axially and circumferentially spaced apart from the first inner air seal 110 by the gap 94. The first inner air seal 110 engages the first shroud segment 84 and the second inner air seal 112 engages the second shroud segment 86. In at least one embodiment, the first inner air seal 110 extends at least partially into the first shroud segment 84 and the second inner air seal 112 extends at least partially into the second shroud segment 86.

Figure 6:
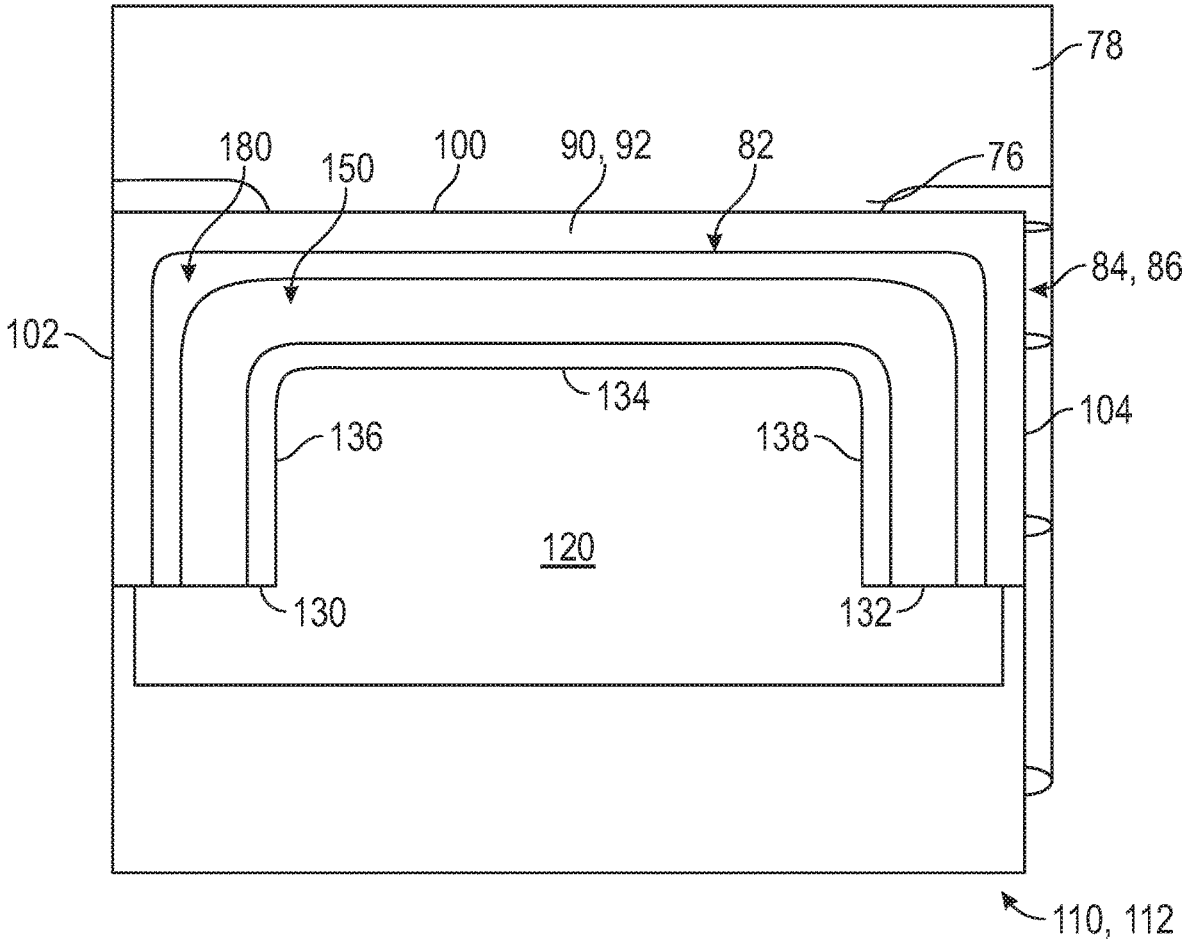
FIG. 6 is a partial end view of a seal assembly that is received between a shroud and an inner air seal of the vane assembly.

Referring to FIGS. 5 and 6, at least one of the first inner air seal 110 and the second inner air seal 112 includes a first face 120 and a second face 122 that is spaced apart or offset from the first face 120. The first face 120 is disposed substantially parallel to and coplanar with the first end face 90 or the second end face 92. The second face 122 is disposed substantially parallel to but not coplanar with the first end face 90 or the second end face 92. The spacing apart of the first face 120 from the second face 122 in conjunction with the first platform 100, the first leg 102, and the second leg 104 define a first trench 124 there between.

Furthermore, at least one of the first inner air seal 110 and the second inner air seal 112 includes a first surface 130, a second surface 132, a third surface 134, a fourth surface 136, and a fifth surface 138, all of the surfaces extend between the first face 120 and the second face 122.

The first surface 130 and the second surface 132 are spaced apart from each other and are disposed parallel to each other and to the first platform 100. The first surface 130 and the second surface 132 extend between the first face 120 and the second face 122. The third surface 134 is disposed parallel to but not coplanar with the first surface 130, the second surface 132, and the first platform 100. The third surface 134 is disposed closer to the first platform 100 than the first surface 130 and the second surface 132. The third surface 134 is spaced apart from the first platform 100. The third surface 134 extends between the first face 120 and the second face 122.

The fourth surface 136 is disposed generally perpendicular to the first surface 130. The fourth surface 136 extends between the first surface 130 and the third surface 134. The fourth surface 136 extends between the first face 120 and the second face 122. The fifth surface 138 is spaced apart from and is disposed parallel to but not coplanar with the fourth surface 136. The fifth surface 138 is disposed generally perpendicular to the second surface 132. The fifth surface 138 extends between the second surface 132 and the third surface 134. The fifth surface 138 extends between the first face 120 and the second face 122.

As arranged, the first trench 124 may be defined between the first face 120 and the second face 122. In other words, the first trench 124 may be defined by the first face 120, the second face 122, the first surface 130, the second surface 132, the third surface 134, the fourth surface 136, and the fifth surface 138. The first trench 124 is arranged as a recessed cavity that extends into at least one of the shroud 74 or the inner air seal 80.

Referring to FIGS. 3, 4, and 6, the seal assembly 82 is disposed within the first trench 124. In at least one embodiment, the seal assembly 82 engages an inner surface of the first shroud segment 84 or the second shroud segment 86 and an inner surface of the first inner air seal 110 or the second inner air seal 112.

The seal assembly 82 may be incorporated between the first shroud segment 84 and the second shroud segment 86 to bridge or seal the gap 94. The seal assembly 82 may also be disposed between adjacent vane platforms to seal a gap that may be present between adjacent vane platforms. The seal assembly 82 may have a cross-sectional diameter or cross-sectional form that is greater than a width of the gap 94 or gap between adjacent vane platforms.

The seal assembly 82 may be provided as an individual component that is disposed between segments of the vane assembly 60 or may be provided with or integral to at least one of the first inner air seal 110 or the second inner air seal 112.

Referring to FIG. 4, the seal assembly 82 includes a hollow member 150 and a fill 152 that is disposed within the hollow member 150. The hollow member 150 may be made of a first material. The fill 152 may be made of a second material that is different from the first material. For example, the second material may be material having a higher degree of flexibility or compressibility as compared to the first material.

Referring to FIGS. 3 and 4, the hollow member 150 extends between a first end 160 that may engage the first surface 130 of the inner air seal 80 and a second end 162 that may engage the second surface 132 of the inner air seal 80. In at least one embodiment, the hollow member 150 extends across the gap 94 such that the first end 160 and the second end 162 engage an inner surface of the second inner air seal 112. The hollow member 150 includes a first portion 164, a second portion 166, and a third portion 168.

The first portion 164 extends from the first end 160 and extends towards the third portion 168. The first portion 164 engages an inner surface of the first leg 102. The second portion 166 extends from the second end 162 and extends towards the third portion 168. The second portion 166 engages an inner surface of the second leg 104. The third portion 168 extends between respective ends of the first portion 164 and the second portion 166. The third portion 168 engages an inner surface of the first platform 100.

Figure 7:
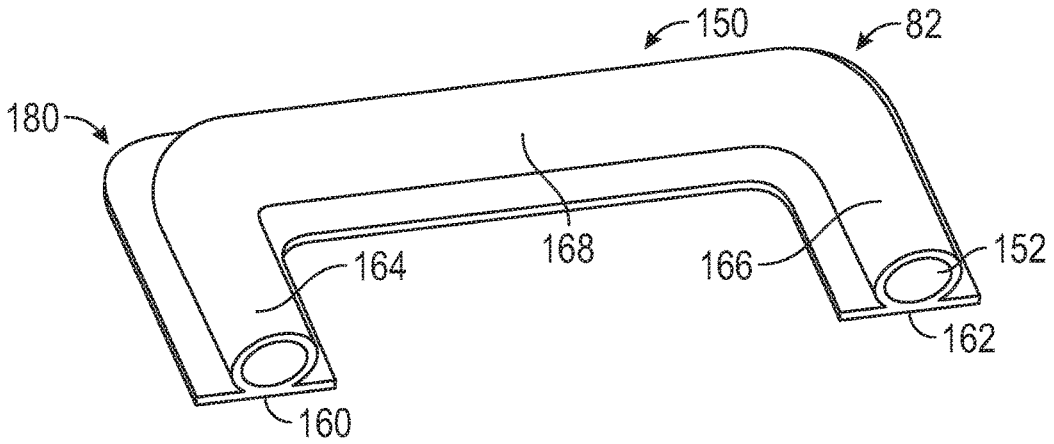
FIG. 7 is a perspective view of the vane assembly.

Referring to FIGS. 6 and 7, the seal assembly 82 may include the hollow member 150 and a foot or pedestal 180 that is connected to the hollow member 150. The hollow member 150 is spaced apart from an inner surface of the shroud 74. The first portion 164 extends from the first end 160 that engages the first surface 130 and extends towards the third portion 168, but is spaced apart from an inner surface of the first leg 102. The second portion 166 extends from the second end 162 that engages the second surface 132 and extends towards the third portion 168, but is spaced apart from an inner surface of the second leg 104. The third portion 168 extends between the first portion 164 and the second portion 166 and is spaced apart from an inner surface of the first platform 100.

The pedestal 180 extends between the first end 160 and the second end 162. The pedestal 180 engages the second face 122 of the inner air seal 80. The pedestal 180 may engage at least one of the first surface 130, the second surface 132, the third surface 134, the fourth surface 136, and the fifth surface 138. The pedestal 180 may also engage an inner surface of the first leg 102, an inner surface of the second leg 104, and an inner surface of the first platform 100.

The seal assembly 82 may be a compressible seal that is provided to prevent, inhibit, or reduce leakage between segments of the vane assembly 60. The seal assembly 82 may reduce or inhibit flow separation proximate either of the first radial boundary end 72 or the second radial boundary end 76 attributable to leakage through gaps between segments of the vane assembly 60.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vane assembly for a gas turbine engine, comprising:

a first shroud segment having a first end face;

a second shroud segment disposed adjacent to the first shroud segment and having a second end face that faces towards and is spaced apart from the first end face by a gap;

a first inner air seal that extends into the first shroud segment and defines a first trench;

a second inner air seal disposed adjacent to the second shroud segment and being arranged for engagement with the second shroud segment; and a seal assembly including a hollow member made of a first material and a fill disposed within the hollow member that is made of a second material, the seal assembly at least partially received within the first trench and engaged to an inner surface of the first shroud segment and an inner surface of the first inner air seal.

2. The vane assembly of claim 1, wherein the seal assembly is at least partially received between the second inner air seal and the second shroud segment.

3. The vane assembly of claim 2, wherein the seal assembly engages an inner surface of the second inner air seal.

4. A vane assembly for a gas turbine engine, comprising:

a first shroud segment having a first platform, a first leg extending from the first platform, and a second leg extending from the first platform and spaced apart from the first leg;

a first inner air seal at least partially extends into the first shroud segment, the first inner air seal having a first face, a second face spaced apart from the first face, a first surface that engages the first leg, a second surface that engages the second leg, a third surface disposed parallel to the first surface and the second surface and spaced apart from the first platform, a fourth surface extending between the first surface and the third surface, and a fifth surface extending between the second surface and the third surface, the first inner air seal defining a first trench therebetween; and a seal assembly including a hollow member that is spaced apart from the first platform, the first leg, and the second leg, the seal assembly further including a pedestal that is operatively connected to the hollow member, and the seal assembly being received within the first trench.

5. The vane assembly of claim 4, wherein the pedestal engages the second face and engages at least one of the first surface, the second surface, the third surface, the fourth surface, and the fifth surface.

6. The vane assembly of claim 5, wherein the pedestal engages the first leg, the second leg, and the first platform.

7. A gas turbine engine, comprising:

a vane assembly provided with at least one of a fan section and a compressor section, the vane assembly comprising:

a first shroud segment disposed adjacent to and spaced apart from a second shroud segment, the first shroud segment having a first leg and a second leg each extending from a first platform, a first inner air seal disposed adjacent to and spaced apart from a second inner air seal, the first inner air seal extends into the first shroud segment and defines a first trench between a first face and a second face of the first inner air seal, and a seal assembly including a hollow member extending between a first end that engages a first surface of the first inner air seal that extends between the first face and the second face and a second end that engages a second surface of the first inner air seal that is spaced apart from the first surface and extends between the first face and the second face, the hollow member having a first portion extending from the first end and being spaced apart from the first leg, a second portion extending from the second end and being spaced apart from the second leg, and a third portion extending between the first portion and the second portion and being spaced apart from the first platform, the seal assembly including a pedestal that is operatively connected to the hollow member and engages the second face, the seal assembly beings at least partially disposed within the first trench.

8. The gas turbine engine of claim 7, wherein the hollow member has a first portion extending from the first end and engages the first leg, a second portion extending from the second end and engages the second leg, and a third portion extending between the first portion and the second portion and engages the first platform.

9. The gas turbine engine of claim 7, wherein a fill is disposed within the hollow member.

* * * * *